US005815851A

United States Patent [19]

Perry

[11] Patent Number: 5,815,851

[45] Date of Patent: Oct. 6, 1998

[54] COLLAPSIBLE URINAL SPLASH SHIELD

[76] Inventor: Reginald S. Perry, 75 Oaklawn Ave. Apt. #103, Cranston, R.I. 02920

[21] Appl. No.: 758,495

[22] Filed: Dec. 2, 1996

[51] Int. Cl.[6] ..... A47K 13/08

[52] U.S. Cl. ..... 4/300.3; 4/DIG. 5

[58] Field of Search ..... 4/300.3, DIG. 5, 4/DIG. 18, 245.1, 245.2, 245.3, 245.5, 245.6, 245.7, 520, 658

[56] References Cited

U.S. PATENT DOCUMENTS

| | | | |
|---|---|---|---|
| D. 245,425 | 8/1977 | Annis . | |
| D. 274,288 | 6/1984 | Shanks . | |
| D. 283,834 | 5/1986 | Grudzinskas . | |
| 612,076 | 10/1898 | Weston | 4/239 |
| 1,108,460 | 8/1914 | Mesick et al. | 4/245.5 |
| 4,348,776 | 9/1982 | Sarjeant | 4/300.3 |
| 4,932,083 | 6/1990 | Arozena . | |
| 5,216,760 | 6/1993 | Brown et al. | 4/300.3 |
| 5,276,925 | 1/1994 | Blaha . | |
| 5,345,619 | 9/1994 | Harrington . | |

*Primary Examiner*—Charles R. Eloshway

[57] ABSTRACT

A urinating splash shield for use with conventional toilets which includes a splash shield and radial attachment ring. The splash shield is flipped up for use and down for nonuse. The attachment ring enables the splash shield to seat within the toilet bowl mouth. The device isolates the toilet seat from the urine stream thereby negating any additional need to clean the toilet seat.

6 Claims, 3 Drawing Sheets

COLLAPSIBLE URINAL SPLASH SHIELD

BACKGROUND OF THE INVENTION

The present invention relates to the field of urinating aids for toilets. More particularly, it relates to an adjustable, urinating splash shield for diverting urine into a toilet bowl to which said device is attached. Although many types of urinal modifications exist adapting the same for use upon standard toilets, none are as simple and reliable as the one Applicant herein has invented.

A common problem in the use of toilets by males involves the inadvertent splashing of urine on regions surrounding the toilet bowl. This problem is particularly severe when the toilet is being used by either a large number of individuals or individuals who are elderly or infirm. Many devices previously contemplated which purport to resolve this problem do so by adding a dedicated urinal portion to the toilet. For example, Harrington U.S. Pat. No. 5,345,619 discloses a toilet combined with a swiveling urinal portion. In Harrington, a urinal is provided which swings from the side of a toilet tank to which it is attached into position directly over the center of the toilet bowl. The urinal itself provides a partial shield protecting the area surrounding the back and sides of the toilet bowl from splashing. This device provides no protection for the front of the toilet bowl which is an area susceptible to a great deal of splashing. Grudzinskas U.S. Pat. No. D283,834 and Shanks U.S. Pat. No. D274,288 also disclose a dedicated urinal portion. All of these patents disclose devices which totally replace the current design of toilet installed in individual homes. None provide a device which can be adapted for use upon a preexisting toilet bowl found in the typical home.

Admittedly, Blaha U.S. Pat. No. 5,276,925 does provide such a device. However, Blaha discloses a pleated, collapsible shield addition which attaches to the top of the toilet seat. This design provides no protection to the toilet seat from urine since the toilet seat is in the urine path. Additionally, the directional sliding means which enables the telescoping urinal cone to be positioned would interfere with a user of the device due to its placement. Also the very nature of the cone makes it difficult and undesirable to clean in that it comprises pleats and folds of material, all of which potentially need wiping or scrubbing.

SUMMARY OF THE INVENTION

The device contemplated by this Applicant which overcomes the inherent deficiencies found in the prior art would enable a user to adapt a standard, commonplace toilet to have a collapsible urinal splash shield. The device would be simple to clean, simple to use for children and infirm adults, and would not place the toilet seat in the urine path. Applicant has created such a device. The device fits completely and totally around the inside rim of the toilet bowl. Applicant's device maintains its position by gripping the inside of the toilet bowl in a pressure gripping cuff. To further secure the device, it makes use of the existing toilet seat mounting bolts to situate it upon the bowl. The device flips up into position when in use and provides 360 degree coverage thereby actually increasing the usable area of the toilet opening. To flip the device up, the toilet seat must be lifted per the standard method used for existing toilets. In other words, the device requires lifting of the seat prior to its use thereby completely removing the toilet seat from the urine path.

The device is contemplated to be smooth textured and therefore simple to wipe down or clean. When not in use, it simply flips down. Accordingly, it is an object of the present invention to provide a urine splash shield which eliminates the deficiencies enumerated above while still adequately preventing the splashing of urine on the area surrounding the toilet bowl.

It is also an object of this invention to provide a urine splash shield which can be readily flipped into a downward unusable position which allows the toilet to be quickly converted from a urinal to a toilet.

Still another object of the present invention is to provide a urinal shield which can be easily cleaned and disinfected.

Another object of the present invention is to provide a urine shield which removes the toilet seat from the urine stream path.

It is also an object of the present invention to provide a urine splash shield which is easy to install, maintain in position and adapts to current configurations of toilets.

Yet another object is to provide a urinal splash shield which is simple to use, cost effective to produce and inexpensive.

BRIEF DESCRIPTION OF THE DRAWINGS

The novel features considered characteristic of the invention are set forth in the appended claims. The invention itself, however, both as to its construction and its method of operation, together with additional objects and advantages thereof, will best be understood from the following description of the specific embodiments when read and understood in connection with the accompanying drawings.

DETAILED DESCRIPTION OF THE PREFERRED EMBODIMENT

Figure 1:
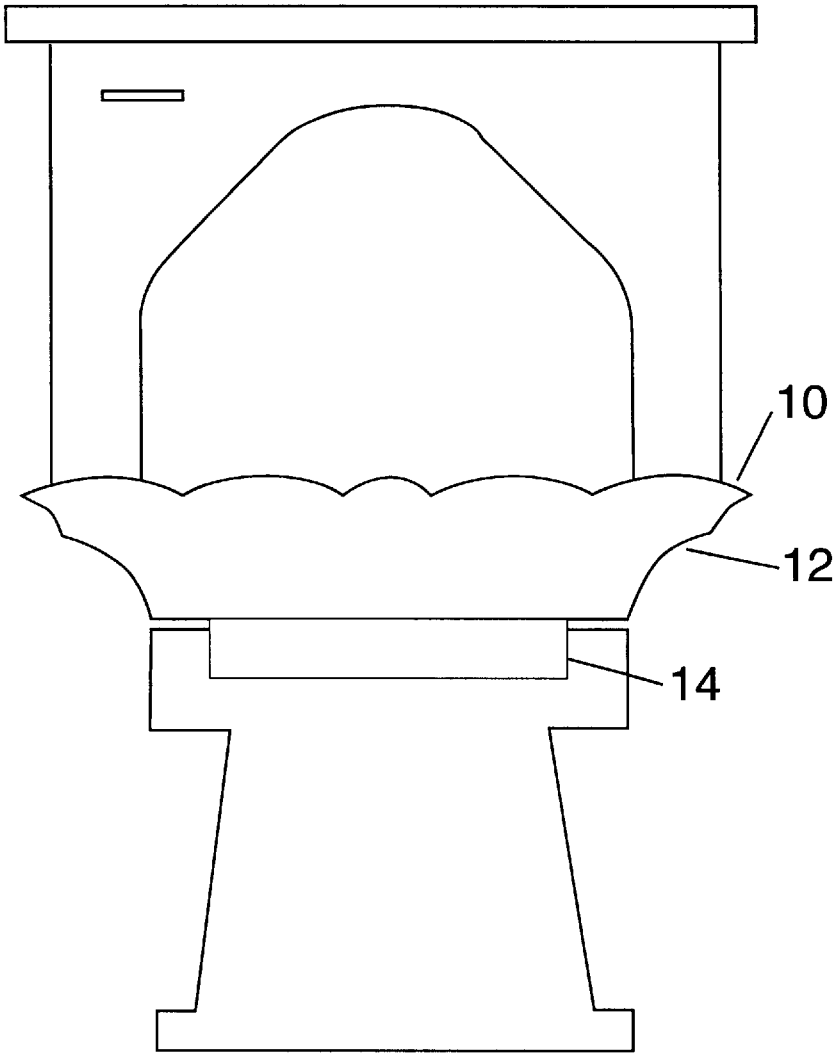
FIG. 1 is a front elevation of a urine splash shield in accordance with the present invention shown mounted to a toilet.
Figure 2:
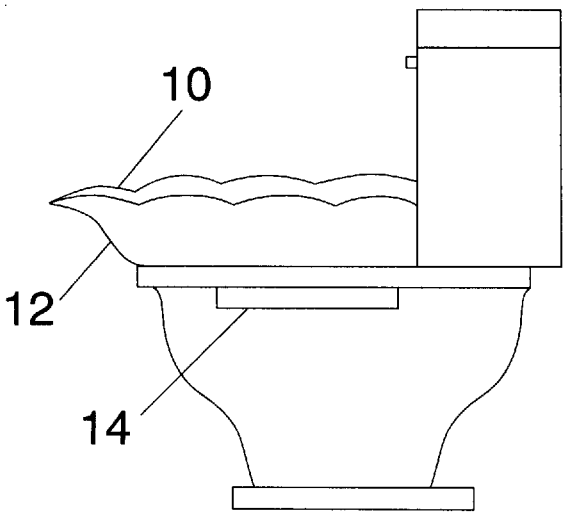
FIG. 2 is a side elevation of the FIG. 1 urinal splash shield in a raised, usable position, with the toilet seat and lid removed for clarity.
Figure 3:
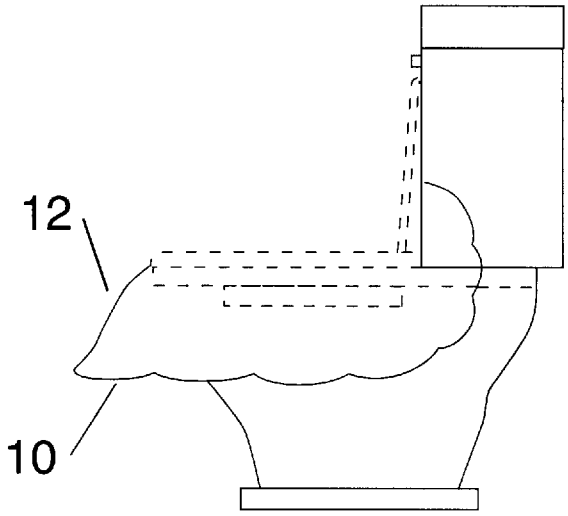
FIG. 3 is a similar side elevation as FIG. 2 with the splash shield in a lowered non-usable position with the toilet seat and lid depicted in phantom; and FIG, 4 is a top plan view of the urinal splash shield depicting holes which attach said guard to a standard toilet.

Reference to the present invention is best had by review of FIGS. 1 through 3. The urine splash shield 10 comprises a splash shield 12 and a radial interior attachment ring or cuff 14. Splash shield 12 must be capable of flipping up and down and remaining in that position. Although a joint assembly could be provided, it is contemplated that no specific joint is needed to accomplish this if the shield 12 were made of a material which could bend or partially fold about an axis. As such the Applicant considers that a plastic, rubber or similar material or composite could accomplish this feature. These materials have the added advantage that they can be made nonreactive and are easily cleaned.

Figure 4:
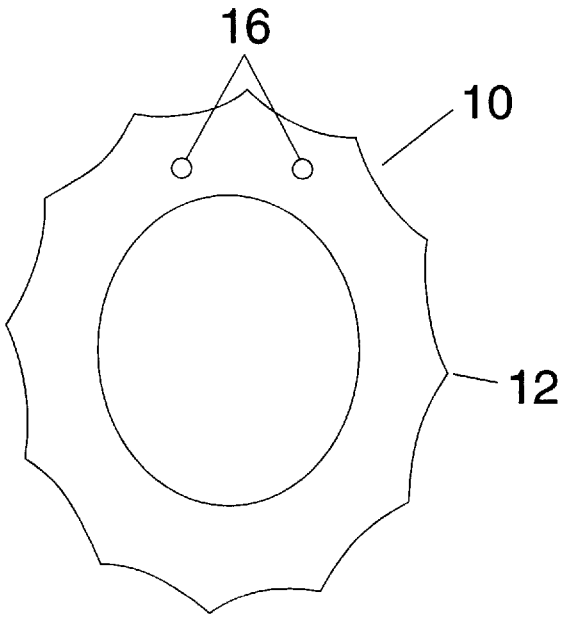

Cuff 14 should be made of a similar material and could be sized to fit various toilet bowl mouth diameters. Nonetheless, the cuff should be at or near the diameter of the toilet bowl mouth in which it will seat to minimize the potential of dislodgment or movement of the device 10. To further secure the device to a toilet bowl, depicted in FIG. 4 is a preferred embodiment which would possess a plurality of attachment holes or slots 16 for the toilet seat mounting bolts to engage. This would ensure that the device remained in position until it was causally removed.

FIGS. 2 and 3 depict the device in an upright and downward position respectively. FIG. 2 shows the upright position or in use position whereas, FIG. 3 depicts the downward or nonuse position. It should be plainly seen by these drawings that the device is easily changed from one position to the other by simply grasping the shield 12 at an outer point and flipping it up or down whichever be the case.

Thus the present invention provides a urinal splash shield that protects the entire area surrounding the toilet from splashing. It also provides a splash shield that can be easily and quickly converted from an in use to a non use embodiment. It does all of these things without sacrificing cleanability. As such, while the invention has been described and illustrated with reference to a specific embodiment, it is understood that other embodiments may be resorted to without departing from the invention. Therefore the form of the invention set out above should be considered illustrative and not as limiting the scope of the following claims.

What is claimed is:

1. A urinal splash shield for use with a toilet having a toilet bowl, a pivotally attached toilet seat, and toilet seat mounting bolts, comprising:

a flexible shield portion adapted to be placed between said toilet bowl and said toilet seat, said shield portion including at least two attachment holes for receiving the toilet seat mounting bolts therein to secure said shield on said toilet bowl; and a radial flexible cuff integrally connected to said shield portion, said cuff adapted to be retained within said toilet bowl by friction and pressure between said cuff and said toilet bowl to hold the urinal splash shield in position on said toilet bowl.

2. The urinal splash shield as claimed in claim 1, wherein said flexible shield portion is movable between an engaged, upwardly open, funnel-shaped use position and a lowered nonuse position.

3. The urinal splash shield as claimed in claim 2, wherein said shield portion is moved from the nonuse position to the use position by pulling said shield portion from the nonuse to the use position.

4. The urinal splash shield as claimed in claim 2, wherein said use position provides an increased toilet bowl target area for urination.

5. The urinal splash shield as claimed in claim 1, wherein said urinal splash shield is texturally smooth for enabling easy cleaning thereof.

6. The urinal splash shield as claimed in claim 1, wherein said urinal splash shield is comprised of rubber.

* * * * *